US007165387B2

(12) United States Patent
Voge et al.

(10) Patent No.: US 7,165,387 B2
(45) Date of Patent: Jan. 23, 2007

(54) FLYER BOW WITH SEMI-ENCLOSED WIRE GUIDES

(75) Inventors: Donglas Allan Voge, West Suffield, CT (US); Scott Scranton, Wallingford, CT (US); David Phelps Strecker, Canton, CT (US)

(73) Assignee: Kamatics Corporation, Bloomfield, CT (US)

( * ) Notice: Subject to any disclaimer, the term of this patent is extended or adjusted under 35 U.S.C. 154(b) by 0 days.

(21) Appl. No.: 11/155,073

(22) Filed: Jun. 17, 2005

(65) Prior Publication Data

US 2006/0196163 A1 Sep. 7, 2006

Related U.S. Application Data

(60) Provisional application No. 60/657,998, filed on Mar. 2, 2005.

(51) Int. Cl.
*D01H 7/26* (2006.01)

(52) U.S. Cl. ..... 57/115

(58) Field of Classification Search ..... 57/67–71, 57/115–118

See application file for complete search history.

(56) References Cited

U.S. PATENT DOCUMENTS

| | | | | |
|---|---|---|---|---|
| 5,509,260 | A * | 4/1996 | Derdeyn | 57/58.83 |
| 6,223,513 | B1 | 5/2001 | Post et al. | |
| 6,289,661 | B1 * | 9/2001 | Boland | 57/58.63 |
| 2004/0172932 | A1 * | 9/2004 | Watkins | 57/67 |
| 2006/0000198 | A1 * | 1/2006 | Priegelmeir et al. | 57/115 |

FOREIGN PATENT DOCUMENTS

EP 569730 A1 * 11/1993

* cited by examiner

*Primary Examiner*—Shaun R. Hurley
(74) *Attorney, Agent, or Firm*—Cantor Colburn LLP

(57) ABSTRACT

Disclosed herein is a flyer bow for use in a wire-twisting machine including a body with an airfoil shaped cross section, a recessed channel within the body and a series of wire guide inserts retained within the recessed channel. Further disclosed herein is a wire guide insert including a tubular body having an exterior non-circular shape corresponding to a similar non-circular shape of a channel and an exhaust opening in the wire guide inserts.

12 Claims, 3 Drawing Sheets

FLYER BOW WITH SEMI-ENCLOSED WIRE GUIDES

CROSS REFERENCE TO RELATED APPLICATION

This application claims the benefit of U.S. Provisional Patent Application No. 60/657,998, filed on Mar. 2, 2005, the entire contents of which are incorporated herein by reference.

BACKGROUND

This invention relates to flyer bows. Flyer bows for use on twisting machines are well known in the art. Twisting machines with flyer bows can be used to make twisted cables for a wide variety of uses. Flyer bows can be used with pairing, tripling, quadding, bunching and twisted machines for wires. A typical flyer bow is generally rectangular in cross section. Wires to be twisted pass longitudinally along the inside surface of the flyer bow and are guided along the surface through ceramic or metal wire guides. A groove or recessed channel in the inside surface of the flyer bow is often incorporated into the design of the flyer bow in order to nest the wires to be twisted close to the surface of the flyer bow. This configuration reduces drag on the wires due to wind that sweeps transversely across the flyer bow during use. Flyer bows with airfoil shapes have been successfully used to increase speed of the winding machines with the benefits of minimum power draw and reduced operational noise. However, the airfoil does little, if anything, to minimize the effect of drag on the exposed wires. Furthermore, the exposed wire guides create additional drag on the flyer bow as it rotates.

An existing flyer bow is described in U.S. Pat. No. 6,223,513 B1, issued to Post et al. and assigned to Kamatics Corporation, the entire contents of which are incorporated herein by reference. U.S. Pat. No. 6,223,513 B1 discloses a flyer bow with an integral enclosed wire guide. This design reduces drag by incorporating the wire guide within the flyer bow.

BRIEF DESCRIPTION OF THE INVENTION (SUMMARY)

Disclosed here in is a flyer bow for use in a wire-twisting machine including a body with an airfoil shaped cross section, a recessed channel within the body and a series of wire guide inserts retained within the recessed channel.

Further disclosed herein is a wire guide insert including a tubular body having an exterior non-circular shape corresponding to a similar non-circular shape of a channel and an exhaust opening in the wire guide inserts.

BRIEF DESCRIPTION OF THE DRAWINGS

Referring now to the drawings wherein like elements are numbered alike in the several Figures.

DETAILED DESCRIPTION

Figure 1:
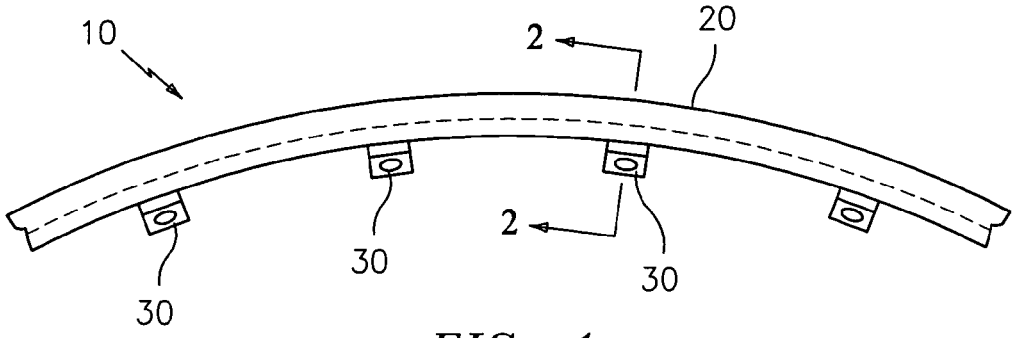
FIG. 1 (PRIOR ART)
FIG. 1 is a front plan view of a conventional flyer bow.
Figure 2:
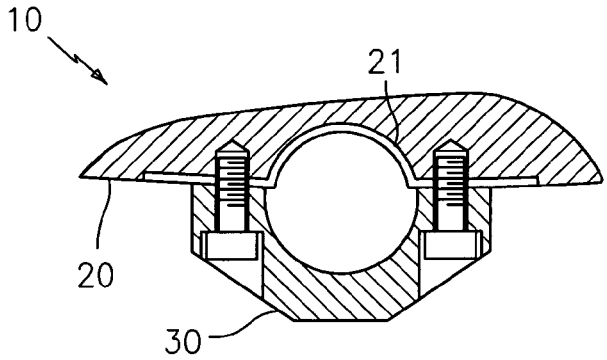
FIG. 2 (PRIOR ART)
FIG. 2 is a cross section view of the flyer bow of FIG. 1 taken at arrows 2—2.

Referring to FIGS. 1 and 2, a conventional flyer bow 10 includes a body 20, the wire guides 30 and the recessed channel 21. The recessed channel 21 and the airfoil shape of the body 20 illustrate conventional techniques incorporated to minimize the drag of the flyer bow 10 during operation of the twisting machine. Protrusion of the wire guides 30 outside the airfoil shape of the body 20 and into the air stream result in higher drag, less efficiency and more power consumption.

Figure 3:
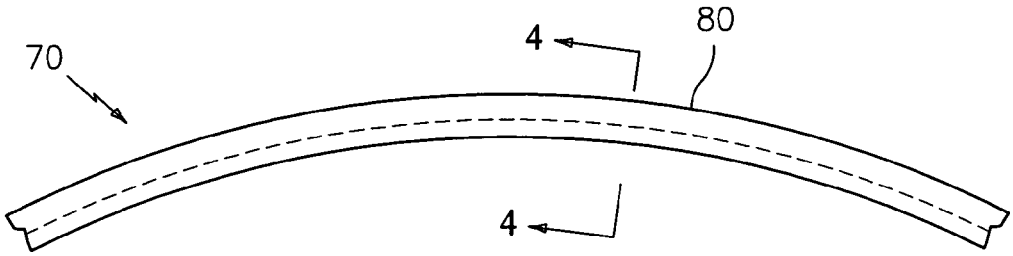
FIG. 3 is a front plan view of a flyer bow depicting one embodiment of the present invention.
Figure 4:
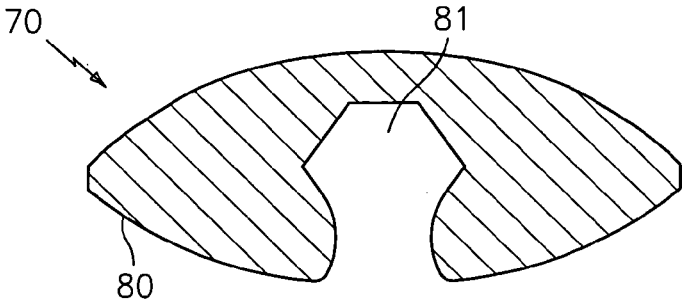
FIG. 4 is a cross section view of the flyer bow of FIG. 3 taken at arrows 4—4.

Referring to FIGS. 3 and 4, in one embodiment of the invention the flyer bow 70 includes an aerodynamic airfoil shaped body 80 with a recessed hexagonal shaped channel 81, without the use of wire guides that protrude into the air stream resulting in higher aerodynamic losses. In tests conducted on wire twisting machines, embodiments of the invention consumed 12.3% less power than a conventional steel body with exposed wire guides and 4.6% less power than a conventional composite airfoil shaped body with exposed wire guides. In addition to the extra power required to run the twisting machines (electric power costs) there was more noise.

Figure 5:
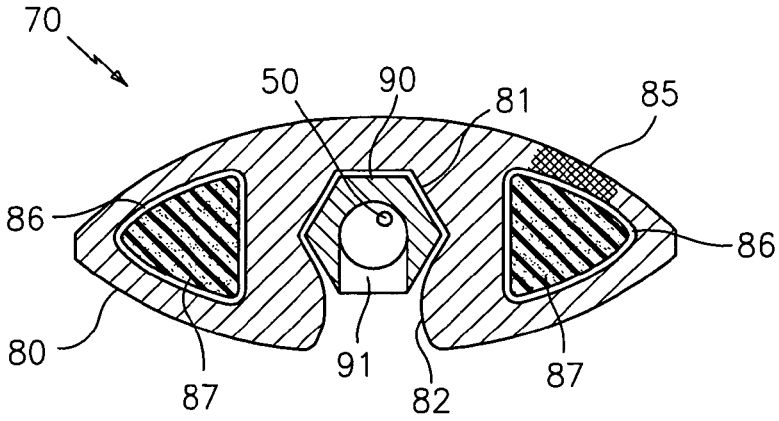
FIG. 5 is a cross section view of an alternate embodiment of the invention showing the wire guide insert in the hexagonal channel.
Figure 7:
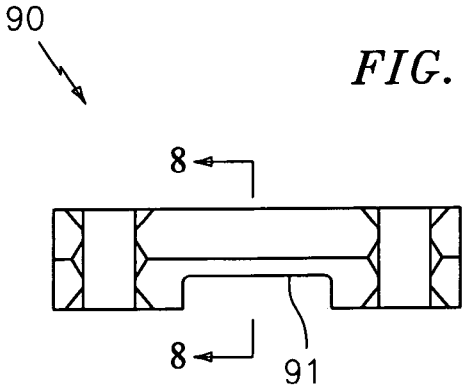
FIG. 7 is a front plan view of the wire guide insert of FIG. 6.
Figure 8:
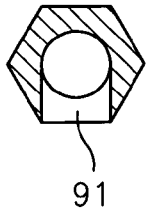
FIG. 8 is a section view of the wire guide insert of FIG. 7 taken at arrows 8—8.

Referring to FIG. 5, an alternate embodiment illustrates the use of wire guide inserts 90, that are retained completely within the airfoil shape of the body 80 in channel 81. The hexagonal shape of the insert 90 matches that of channel 81 to prevent rotation of the insert 90 within the channel 81, which maintains alignment of the insert opening 91, as best depicted in FIGS. 7 and 8, with the channel opening 82. Both the insert opening 91 and the channel opening 82 allow for egress of dust that is created by the wire 50 passing through the wire guide inserts 90 during operation of the twisting machine. This feature provides for a self-cleaning design and provides for a maintenance free feature so that the twisting machine does not have to be shut down to clear the dust that could clog the channel in the bow.

Though a hexagonal shaped insert 90 and hexagonal channel 81 are depicted in this embodiment in FIG. 5, it should be understood that any non-circular shaped cross section that provides for anti-rotation of the insert 90 within the channel 81 (such as an ellipse, square, pentagon, octagon, etc.) could adequately serve this function without deviating from the present invention.

Figure 6:
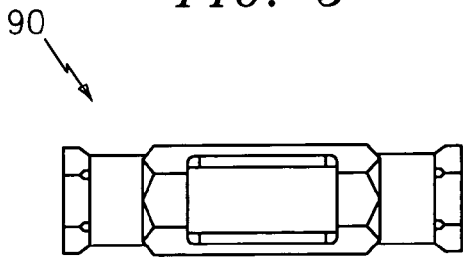
FIG. 6 is a bottom plan view of a hexagonal wire guide insert.

The wire guide inserts 90 shown in FIGS. 6 through 8 are assembled into channel 81 from either end of the body 80 in an end-to-end fashion. The wire guide inserts 90 abut each other along the channel 81 to maintain the position of the wire guide inserts 90 within the channel 81. The wire guide inserts 90 at the ends of the body 80 are secured in position by a retainer (not shown).

The wire guide inserts 90 can be constructed of any material that has a hard, wear resistant surface, to resist wear by the wire that passes through them. A partial material listing includes: steel, or steel that has had a surface plating or coating applied to it to increase the hardness such as titanium carbo-nitride (TiCN), titanium-nitride (TiN), electrolytic or electroless nickel plating, chrome plating, ceramic coatings, etc. The insert can also be made of nickel based alloys such as inconel, ceramic materials, plastic composites, etc.

Figure 9:
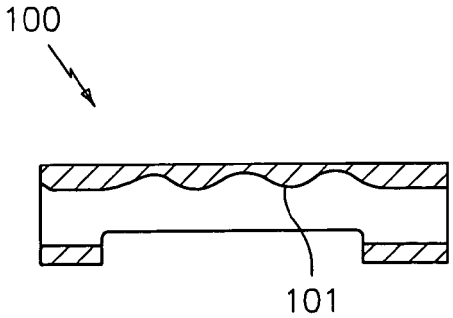
FIG. 9 is an alternate embodiment with corrugated bumps on the inside diameter of the wire guide insert.

The wire guide inserts 100 as shown in FIG. 9, can also be shaped with an undulating interior surface 101, that reduces the contact area with the wire 50 that passes through the inserts 100, thereby decreasing the frictional forces and resulting drag on the wire.

The body 80, as shown in FIG. 5, can be constructed from composite material including but not limited to carbon fiber epoxy, fiberglass epoxy, aramid fiber epoxy, or a combination of two or three of the materials mentioned. The body 80 may be reinforced with a carbon fiber 85 material using a braided structure for the carbon fibers 85. The use of a braided fiber 85 construction is also unique as this type of construction increases the strength of the body 80 and allows the body 80 to have increased damage tolerance and increased resistance to fractures due to impacts from wire 50 strikes. The wire 50 that passes through the wire twisting machine will at times break and the broken wire 50 can impact the body 80 which is rotating at a high speed in the machine. The braided fiber 85 construction is more resilient to wire 50 strikes and the braided fiber 85 construction works to arrest any cracks that may be initiated due to a wire 50 strike resulting in a longer body 80 life.

Figure 10A:
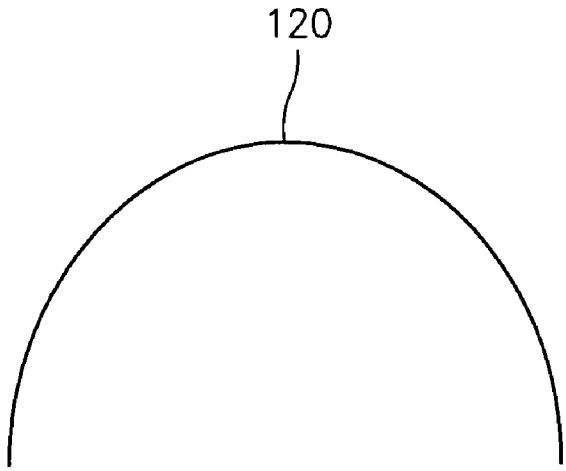
FIG. 10A illustrates the shape of a rotating flyer bow in embodiments of the invention.
Figure 10B:
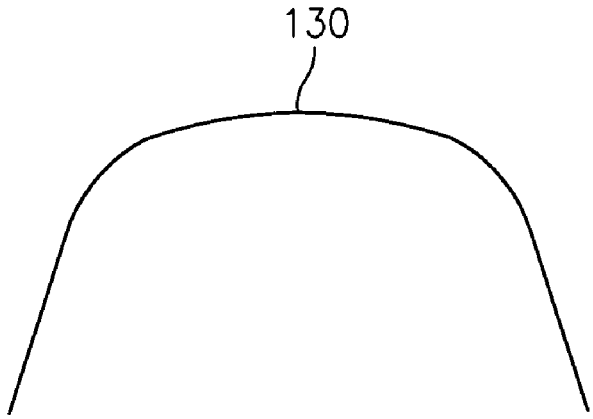
FIG. 10B (PRIOR ART)
FIG. 10B illustrates the shape of a rotating, conventional flyer bow.

Referring again to FIG. 5, the body 80 of the bow may also have hollow sections 86 to decrease the weight while increasing the stiffness and give it an I-beam geometric shape. The reduction of weight of the body 80 reduces the centrifugal pull on the airfoil body 80 attachment ends. The hollow sections 86 can also be filled with foam 87 to further increase stiffness of the body 80 without adding significantly to the weight of the body 80. The thicker section that is provided by the use of an airfoil section to contain the wire guide inserts 90 and the wire 50 internally, also produces a stiffer airfoil cross section. This stiffer cross section enables the body to keep its as manufactured curved shape 120 even under the high centrifugal loads that are imposed on the body when it is spinning in the wire twisting machine as is depicted in FIG. 10A. Conventional designs with thinner cross sections tend to produce an irregular shape 130 and tend to flatten at the apex of the bow while rotating as shown in FIG. 10B. The result of the irregular shape 130 is that the wire makes greater contact with the wire guides and degrades the quality of the wire due to the abrasion by the greater contact area and force.

While preferred embodiments have been shown and described, various modifications and substitutions maybe made thereto without departing from the spirit and scope of the invention. Accordingly, it is to be understood that the present invention has been described by way of illustration and not limitation.

What is claimed is:

1. A flyer bow for use in a wire twisting machine comprising:

a body with an airfoil shaped cross section, a recessed channel within the body, a series of a plurality of individual wire guide inserts retained within the recessed channel;

wherein the wire guide inserts are contained within the recessed channel such that no portion of the wire guide inserts protrudes beyond the envelope defined by the airfoil shape of the body.

2. The flyer bow claimed in claim 1 wherein:

the wire guide inserts are rotationally locked within the recessed channel by the matching of a non-circular shape of the wire guide insert to that of the recessed channel.

3. The flyer bow claimed in claim 2 wherein: the non-circular shape of the wire guide inserts and recessed channel are hexagonal.

4. A flyer bow for use in a wire twisting machine comprising:

a body with an airfoil shaped cross section, a recessed channel within the body, a series of wire guide inserts retained within the recessed channel;

wherein the wire guide inserts are rotationally locked within the recessed channel by the matching of a non-circular shape of the wire guide insert to that of the recessed channel;

wherein an opening in one side of the wire guide insert is aligned with an opening in the recessed channel to facilitate egress of contamination.

5. The flyer bow claimed in claim 1 wherein:

the body is made of a composite material reinforced with carbon fibers.

6. The flyer bow claimed in claim 5 wherein:

the carbon fibers are braided.

7. The flyer bow claimed in claim 1 wherein:

a portion of the body is hollow.

8. The flyer bow claimed in claim 1 wherein:

a portion of the body is made of a foamed material.

9. A wire guide insert comprising:

a tubular body having an exterior non-circular shape taken along the cross-section of the tubular body across the longitudinal axis of the tubular body corresponding to a similar non-circular shape of a channel in a flyer bow, an exhaust opening in the wire guide insert.

10. A wire guide insert claimed in claim 9 wherein:

the non circular shape of the wire guide insert is hexagonal.

11. A wire guide insert claimed in claim 9 wherein:

the interior surface of the wire guide is undulating.

12. A flyer bow for use in a wire twisting machine comprising:

a body with an airfoil shaped cross section, a recessed channel within the body, a series of a plurality of individual wire guide inserts retained within the recessed channel;

wherein the recessed channel includes a continuous channel opening traversing the longitudinal length of the body;

wherein the wire guide inserts include an insert opening aligned with the channel opening.

* * * * *